US007515107B2

(12) United States Patent
Saliga

(10) Patent No.: US 7,515,107 B2
(45) Date of Patent: Apr. 7, 2009

(54) MULTI-BAND ANTENNA

(75) Inventor: Stephen V. Saliga, Akron, OH (US)

(73) Assignee: Cisco Technology, Inc., San Jose, CA (US)

( * ) Notice: Subject to any disclaimer, the term of this patent is extended or adjusted under 35 U.S.C. 154(b) by 109 days.

(21) Appl. No.: 11/690,448

(22) Filed: Mar. 23, 2007

(65) Prior Publication Data

US 2008/0233888 A1 Sep. 25, 2008

(51) Int. Cl.
*H01Q 1/24* (2006.01)

(52) U.S. Cl. ..... 343/700 MS; 343/846

(58) Field of Classification Search ..... 343/700 MS, 343/846, 702, 829
See application file for complete search history.

(56) References Cited

U.S. PATENT DOCUMENTS

| | | | | |
|---|---|---|---|---|
| 3,534,378 | A | 10/1970 | Smith | 343/828 |
| 4,083,050 | A | 4/1978 | Hall | 343/729 |
| 7,176,838 | B1 | 2/2007 | Kinezos | 343/700 |
| 2005/0116869 | A1 | 6/2005 | Siegler et al. | 343/749 |
| 2005/0212708 | A1 | 9/2005 | Fifield | 343/702 |
| 2005/0259031 | A1 | 11/2005 | Sanz et al. | 343/895 |
| 2006/0092078 | A1 | 5/2006 | Sanford | 343/700 |
| 2006/0170594 | A1 | 8/2006 | Cheng | 343/700 |
| 2006/0181464 | A1 | 8/2006 | Erkocevic | 343/702 |
| 2006/0227052 | A1 | 10/2006 | Tavassoli Hozouri | 343/700 |
| 2006/0232485 | A1 | 10/2006 | Wen et al. | 343/702 |

FOREIGN PATENT DOCUMENTS

| | | |
|---|---|---|
| CN | 1862880 | 3/2006 |
| EP | 1067628 | 1/2001 |
| EP | 1469553 | 10/2004 |
| EP | 1653558 | 5/2006 |

OTHER PUBLICATIONS

"S24493DS: Dual Band Diversity Antenna" Product Data Sheet, Cushcraft Corporation, Manchester, NH. Downloaded Nov. 21, 2006. Available online at http://www.cushcraft.com/comm/support/pdf/S24993DS.pdf.

"Multiple Band Ceiling Mount Omnidirectional Antenna" Product Data Sheet, PCTEL Broadband Technology Group, Bloomingdale, IL. Downloaded Nov. 21, 2006. Available online at: http://wildcard.pctel.com/images_product_overview/pdf_docs/MC24580304PTMultiBandMCOmni.pdf.

(Continued)

*Primary Examiner*—Tho G Phan
(74) *Attorney, Agent, or Firm*—Dov Rosenfeld; Inventek

(57) ABSTRACT

An antenna comprising: (a) a conductive ground plane; and (b) a rod shaped monopole element having a conductive surface, oriented out from the ground plane and having a length selected for a first radio frequency band, the monopole element having a current suppressing element conductively attached and surrounding the surface of the monopole element at a location on the monopole element determined by a second frequency band higher than the first frequency band. The rod-shaped monopole element has a relatively wide cross-section such that the antenna is operable over relatively wide ranges of frequencies in one or both of the frequency bands. The antenna is for operation in the 2.4 GHz and the 5 GHz bands as used in the IEEE 802.11*a,b,g* standards.

23 Claims, 12 Drawing Sheets

OTHER PUBLICATIONS

"XtremeWave Multiple Band 2.4 GHz, 5.1 GHz and 5.8 GHz Mast Mount Omnidirectional Antenna" Product Data Sheet, PCTEL Broadband Technology Group, Bloomingdale, IL. Downloaded Nov. 21, 2006. Available online at http://wildcard.pctel.com/images_catalog_group/pdf_docs/PCTEL_EXW05.pdf.

"Z2452, Enclosure Mounted Multi-Band Low Profile Vertical Antenna" Product Data Sheet, PCTEL Broadband Technology Group, Bloomingdale, IL. Downloaded May 15, 2007 from http://wildcard.pctel.com/global_staging/index.cgi.

International Search Report on PCT Application PCT/US2008/057400.

Ammann, M.J. et al. "Dual-Band Monopole Antenna With Stagger-Tuned Arms For Broadbanding" Antenna Technology: Small Antennas and Novel Metamaterials, 2005. IWAT 2005. IEEE International Workshop on Singapore Mar. 7-9, 2005, Piscataway, NJ, USA, IEEE, Mar. 7, 2005, pp. 278-281.

100

1000

MULTI-BAND ANTENNA

FIELD OF THE INVENTION

The present disclosure relates generally to wireless communication, and in particular to a multi-band antenna for use in a wireless network.

BACKGROUND

Many devices are designed to operate at more than one frequency range. For example, for wireless local area networks (WLANs), the IEEE 802.11b and IEEE 802.11g standards operate in the IEEE 2.4 GHz range, while the IEEE 802.11a standard is for operation in the 5 GHz band. There are now many IEEE 802.11 devices that operate in both frequency bands, e.g., devices that include two radios that can operate simultaneously, one in the 2.4 GHz band and one in the 5 GHz band. In order to take advantage of diversity, each radio requires at least two antennas or a diversity antenna that includes at least two antennas deployed in the same enclosure.

Thus, it is desirable to have a dual band antenna. There are several dual band antennas on the market aimed at dual frequency WLAN devices. Two examples are the Cushcraft (Cushcraft Corporation, Manchester, N.H.) model S24493DS diversity dual band low profile omnidirectional antenna and the PCTel MC24580304PT single dual band antenna (PCTel Inc., Chicago, Ill.). PCTel also has model Z2452 that is a dual band (single) short omnidirectional antenna. These Cushcraft and PCTel antennas are for operation in the 2.4 GHz and 5 GHz bands.

SUMMARY

Embodiments of the present invention include an antenna, an array of an antenna, a method of making an antenna and a wireless station that includes an embodiment of a dual frequency antenna.

One embodiment includes an antenna comprising: (a) a conductive ground plane; and (b) a rod shaped monopole element having a conductive surface, oriented out from the ground plane and having a length selected for a first radio frequency band, the monopole element having a current suppressing element conductively attached and surrounding the surface of the monopole element at a location on the monopole element determined by a second frequency band higher than the first frequency band. The rod-shaped monopole element has a relatively wide cross-section such that the antenna is operable over relatively wide ranges of frequencies in one or both of the frequency bands.

One embodiment includes an antenna array comprising: (a) a conductive ground plane; and (b) a plurality of rod shaped monopole elements, each having a conductive surface, oriented out from the ground plane and having a length selected for a first radio frequency band, each monopole element having a respective current suppressing element conductively attached and surrounding the surface of the monopole element at a location on the monopole element determined by a second frequency band higher than the first frequency band. Each rod-shaped monopole element has a relatively wide cross-section such that the antenna array is operable over relatively wide ranges of frequencies in one or both of the radio frequency bands.

One embodiment includes a method of manufacturing an antenna comprising: providing a conductive ground plane; providing a rod-shaped monopole element having a conductive surface and having a length selected for a first radio frequency band; providing a current suppressing element including a top conductive face and a bottom conductive face substantially parallel to each other, and a hole configured so that the rod-shaped monopole can fit through the hole of the current suppressing element. The method includes pushing the current suppressing element onto the monopole element or the monopole element into the hole of the current suppressing element such that the top and bottom conductive faces extend out from the conductive surface of the monopole element, and such that the top and bottom conductive faces are conductively coupled to the outer surface of the monopole element at a selected first location determined by a second frequency band higher than the first frequency band. The method further includes arranging the combination of the monopole element and current suppressing element to be substantially perpendicular to the ground plane so the ground plane and the combination form two antenna terminals. The rod-shaped monopole element has a relatively wide cross-section such that the antenna is operable over relatively wide ranges of frequencies in one or both of the frequency bands.

One embodiment includes apparatus comprising a wireless transceiver operable at one of a plurality of frequencies in a band of frequencies at or near 2.4 GHz and simultaneously at one of a plurality of frequencies in a band of frequencies at or near 5 GHz, and an antenna coupled to the wireless transceiver. The antenna includes (a) a conductive ground plane; and (b) a rod shaped monopole element having a conductive surface, oriented out from the ground plane and having a length selected for the 2.4 GHz band of frequencies, the monopole element having a current suppressing element conductively attached and surrounding the surface of the monopole element at a location on the monopole element determined by the 5 GHz band of frequencies. The rod-shaped monopole element has a relatively wide cross-section such that the antenna is operable over relatively wide ranges of frequencies in one or both of the frequency bands.

Particular embodiments may provide all, some, or none of these aspects, features, or advantages. Particular embodiments may provide one or more other aspects, features, or advantages, one or more of which may be readily apparent to a person skilled in the art from the figures, descriptions, and claims herein.

BRIEF DESCRIPTION OF THE DRAWINGS

FIGS. 9A and 9B respectively show the measured azimuth plane patterns and measured elevation plane patterns for an antenna embodiment transmitting at frequencies in the 5 GHz frequency band used in IEEE 802.11a.

DESCRIPTION OF EXAMPLE EMBODIMENTS

Figure 1:
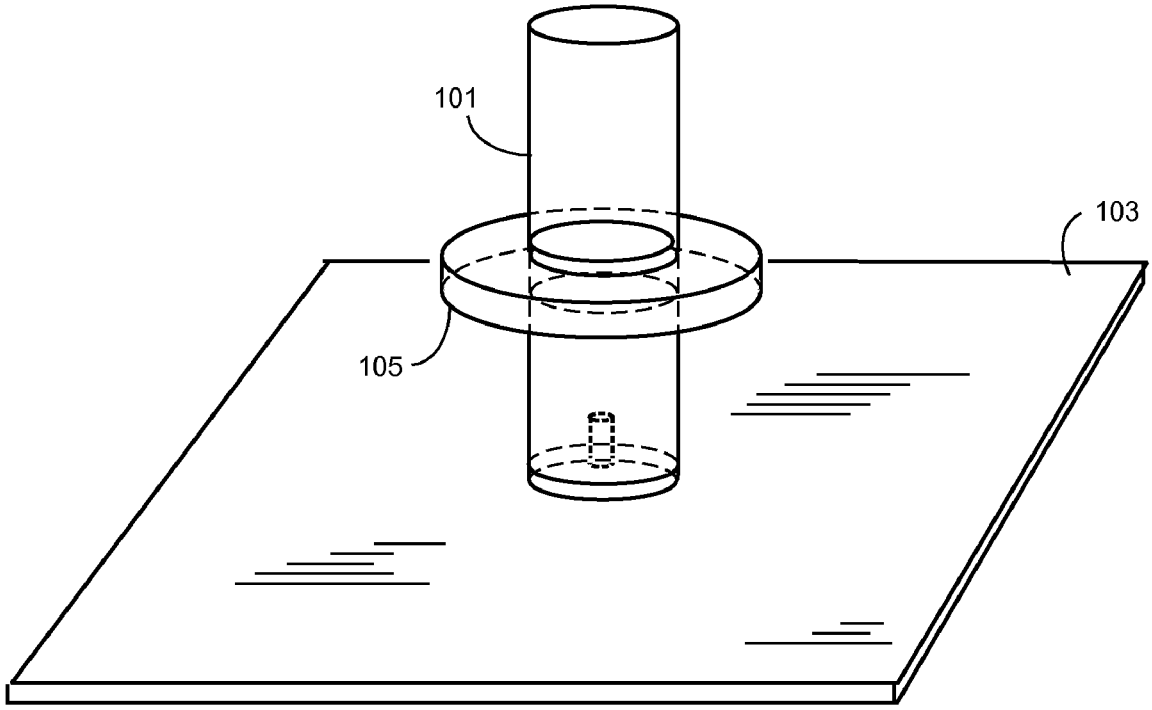
FIG. 1 shows a perspective view of an example embodiment of a dual-band antenna.

FIG. 1 shows a perspective view of an example embodiment of a dual-band antenna 100. The antenna 100 includes a conductive ground plane 103, and a rod shaped monopole element 101 having a conductive surface, oriented out from the ground plane and having a length selected for a first frequency band—the 2.4 GHz band used, e.g., in IEEE 802.11b and 802.11g variants of the IEEE 802.11 WLAN standard. The monopole element has a current suppressing element 105 having a conductive surface conductively attached and surrounding the surface of the monopole element 101 at a selected location on the monopole element 101 determined by a second frequency band higher than the first frequency band, e.g., the 5 GHz band used in the IEEE 802.11a variant of the IEEE 802.11 WLAN standard.

In one embodiment the monopole is made of a first conductive metal material, e.g., brass, and the current suppressing element is made of a second conductive metal material, e.g., aluminum. In another embodiment, both elements 101 and 105 are made of the same conductive metal material.

Figure 2:
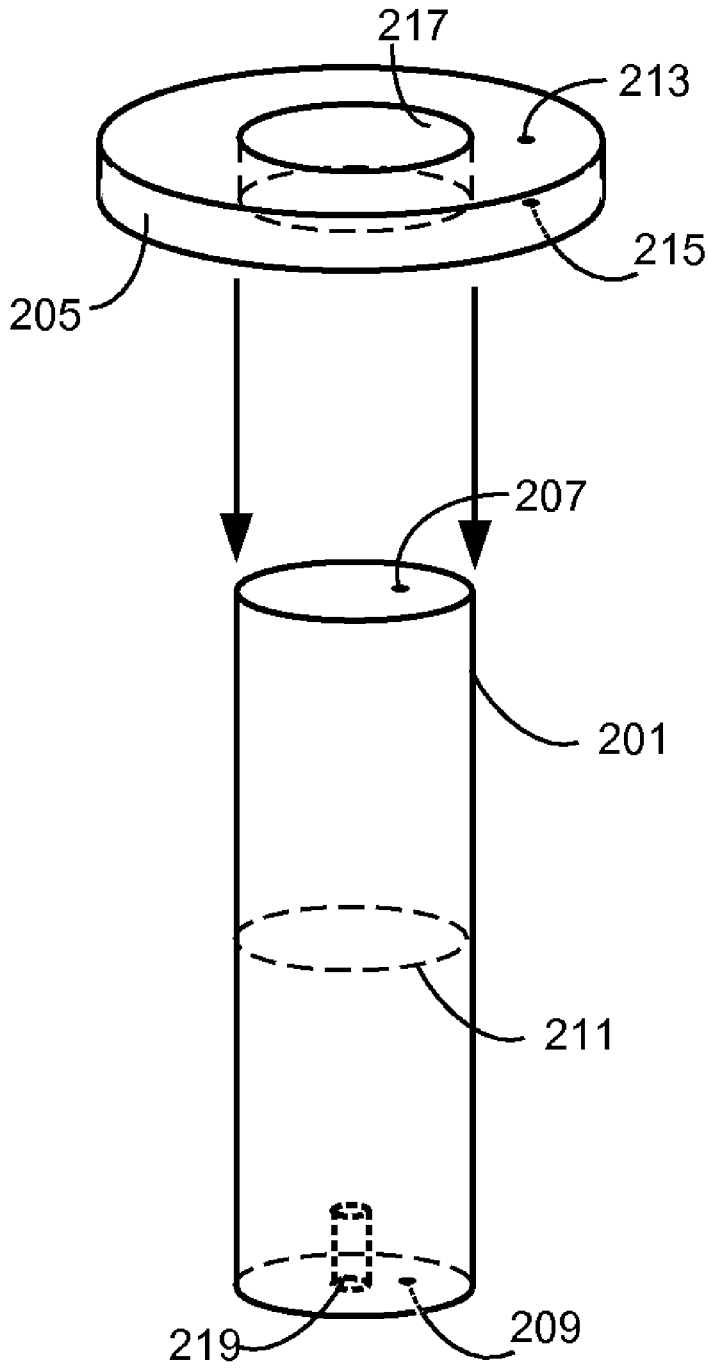
FIG. 2 illustrates one method of making an embodiment of the dual band antenna.

FIG. 2 illustrates one method of making an embodiment of the dual band antenna 100 from a metal cylindrical rod 201 of a the selected length that has a feed end 209 and a top end 207, and pushing thereon a metal current suppressing element 205 that is relatively thin and having a top face 213 and a bottom face 215, e.g., parallel to each other, and a hole having an inner surface 217 and whose dimensions are configured to fit the monopole rod 201 therethrough. The top and bottom surfaces are in one embodiment annular. In one embodiment, the current suppressing element is a round metal washer. The current suppressing element 205 is pushed onto the monopole element 201 until the current suppressing element 205 is at the selected location 211 on the rod 201, with its conductive surface conductively connected to the conductive surface of the monopole element. The manufacturing method includes drilling a feed hole 219 at the feed end 209 such that a center conductor of a coaxial feed wire or a center conductor of a coaxial connector, or a combination thereof can be soldered thereto.

Figure 3:
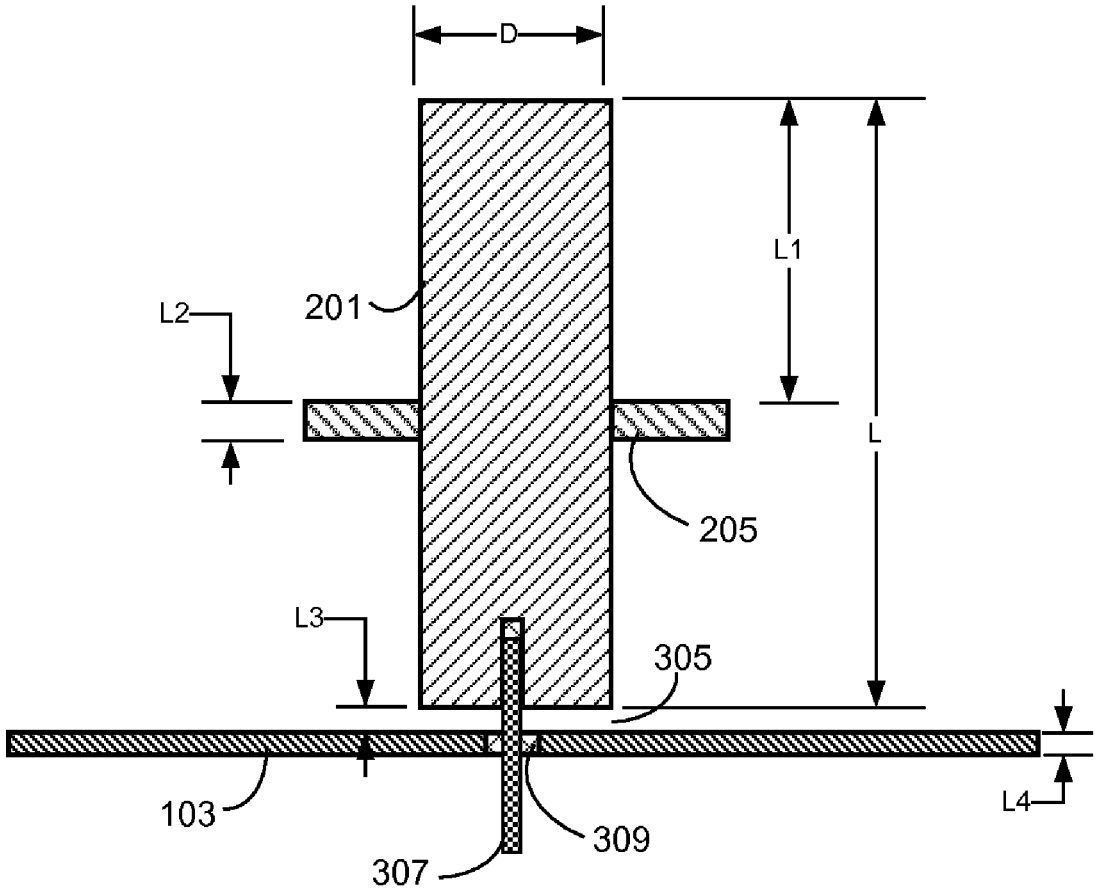
FIG. 3 shows a cross-sectional view of an antenna embodiment as manufactured, for example, using the process described in FIG. 2.

FIG. 3 shows a cross-sectional view of an antenna embodiment as manufactured, for example, using the process described in FIG. 2. The diameter of the monopole is denoted by D. The rod-like monopole is relatively wide. In one embodiment, the diameter is about 6 mm. IN another, the diameter is 6.7 mm. In other embodiments, the monopole is a least 4.7 mm wide in cross-section. The cross-sectional width is selected such that it can cover at least one relatively wide range of frequencies, e.g., 4900-5850 MHz. Too thin a monopole won't cover the entire range of frequencies even of the 2400-2500 MHz range.

The length of the monopole element 201 is denoted L and is selected so that the antenna can operate at the lower of the two frequency bands, e.g., the 2.4 GHz band of IEEE 802.11b and 802.11g. In one embodiment, the length L is approximately one quarter of a wavelength for the lower of the two frequency ranges. At 2450 MHz, that would be about 30 mm. The length is also adjusted to give a desired impedance for the antenna. About 27 mm corresponds to approximately 2400 MHz, and provides an impedance close to 50Ω. Thus, in one embodiment, the length is about 27 mm. Another embodiment has L about 28 mm. The invention is not restricted to a particular length, and a length between 25 mm and 33 mm would work.

The position of the current suppressing element 205 is denoted as L1 from the top end of the monopole element 201. D1 is selected to produce a resonance in the upper frequency band, e.g., 5 GHz range. In one embodiment, the current suppressing element 205 is positioned at L1 of about 13 mm. This can change by a few mm, depending on the width of the desired higher frequency band, and on the thickness of the element. Other embodiments can have L1 between (and including) 11 to slightly more than 14 mm.

The thickness of the current suppressing element is denoted D2. In one embodiment, a value of D2 of about 2.5 mm is selected for the current suppressing element. IN another embodiment, the thickness is about 4 mm is used. Too thin a current suppressing element produces too narrow a range of frequencies of operation in the upper of the two bands, while too thick a current suppressing element affects the impedance, so that it may deviate significantly from the desired impedance, e.g., 50Ω.

In one embodiment, the ground plane is planar and having metallic material on both sides. In one embodiment, the ground plate is made of an aluminum sheet. The thickness, denoted L4, is about 2 mm, and any thickness may be used.

A separation 305 is maintained between the ground plane 103 and the monopole element 201. The separation is denoted L3 in FIG. 3. In one embodiment, L3 is about 1 mm. In one embodiment, a Teflon spacer is placed between the ground plane and the feed end of the rod-like monopole element.

FIG. 3 shows a center conductor 307 of a coaxial cable inserted in the hole 219 soldered thereto. The center conductor passes through a hole 309 through the ground plane 103.

In one embodiment, a panel mount connector is fit to the side of the ground plane opposite the monopole. For example, an SMA panel mount connector that is designed to crimp to a center conductor soldered to a hole in the feed end of the monopole element.

Note that while FIGS. 1 to 3 show current suppressing elements that are ring-like, other shapes are possible. FIGS. 4A-4D shows four alternate shapes, and these certainly are not exhaustive; other shapes are also possible. Each of FIGS. 4A to 4D shows a relatively thin conductive element having a top conductive face and a bottom conductive face, e.g., substantially parallel to each other and to the ground plane, and conductively connected to the outer surface of the monopole, these faces extending out from the surface of the monopole in all directions. In the case that a method of construction similar to that shown in FIG. 2 is shown, each element in FIGS. 4A to 4D includes a hole having a conductive inner surface and whose dimensions are configured to fit relatively tightly over the monopole, such that the conductive element can be conductively coupled to the outer surface of the monopole element at the selected first location.

Figure 4A:
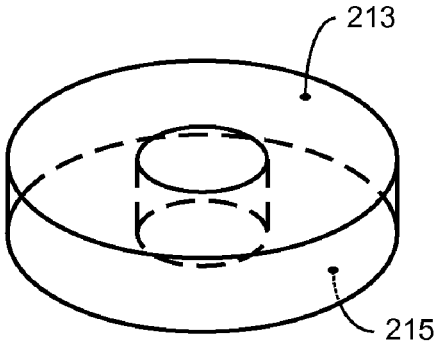
FIGS. 4A-4D show four alternate shapes for a current suppressing element for use in an antenna according to one or more features of the present invention.

In one embodiment shown in FIGS. 2, 3, and 4A, the shapes of the top and bottom faces 213, 215 of the conductive element are annular, e.g., circular with the hole through the center, so that the conductive element is shaped like a thin cylinder with the hole therethrough, e.g., shaped like a common washer. A cross section outline of the monopole and current suppressing element at the location of the current suppressing element is circular in shape.

Figure 4B:
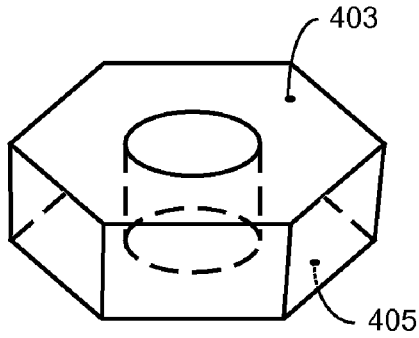
Figure 4C:
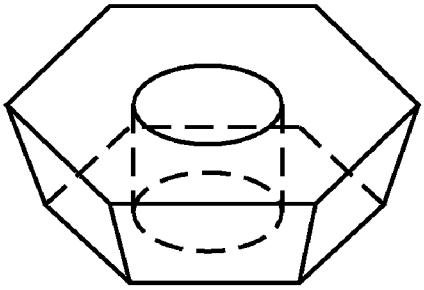
Figure 4D:
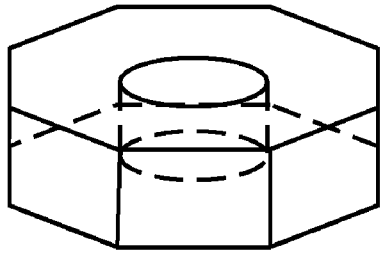

In some other embodiments, e.g., FIGS. 4B-4D, the top and bottom faces are polygonal with the hole through the center, so that the conductive element has a prism shape with a hole through each side. For example, each side could be a square or a polygon of more sides. FIG. 4B shows each of the top and bottom faces 403 and 405 as an equal and aligned hexagon, so that the element is hexagonal nut-like. FIG. 4C shows each of the top and bottom faces as an equal and aligned octagon. Each of the top and bottom faces need not be equal. FIG. 4D shows the top and bottom faces being aligned but different sized hexagons.

Shapes other than those shown in FIGS. 4A-4D also are possible, as would by now be clear to those in the art, and such other shapes are meant to be within the scope of the present invention.

One embodiment includes two or more dual band antennas arranged together to produce an array of two or more antenna elements, a respective plurality of feed cables or connectors suitable for deployment with any multiple antenna device, such as, in the case of and 802.11 network, an access point designed for diversity. For example, the IEEE 802.11n standard and draft standard is meant for operation with multiple antennas.

Figure 5:
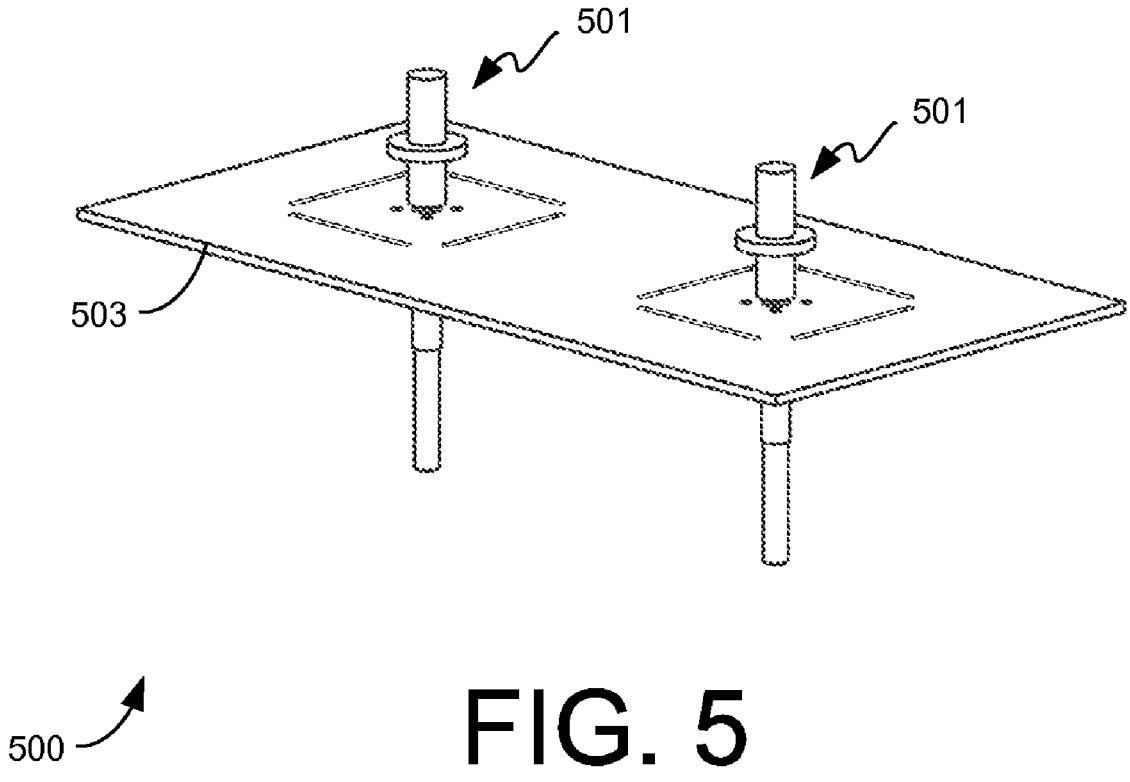
FIG. 5 shows a perspective view on one embodiment of an array of two dual band antennas.

FIG. 5 shows a perspective view on one embodiment 500 of an array of two antennas, each a monopole and current suppressing element combination 501 as described above, with a common ground plane 503.

While the embodiment shown in FIG. 5 shows a single element forming the ground plane, in an alternate embodiment, the conductive ground plane includes a plurality of conductive planar elements.

Figure 6A:
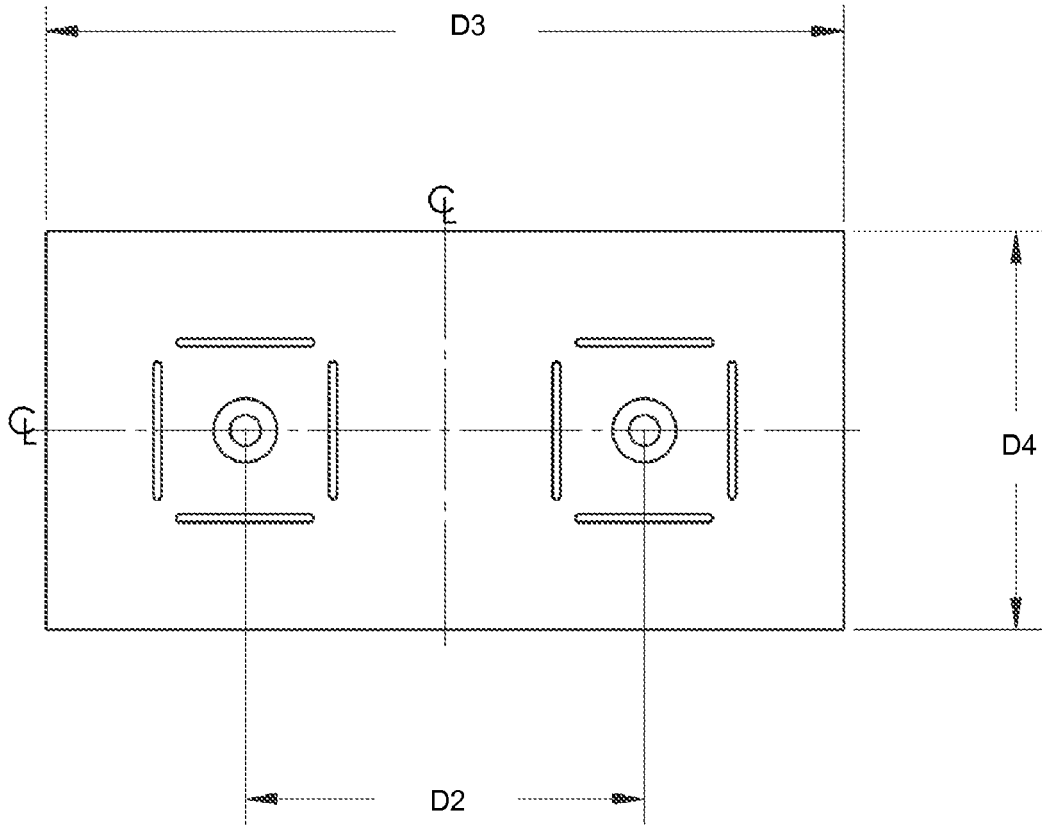
FIGS. 6A and 6B show top and side views of the dual antenna embodiment of FIG. 5.
Figure 6B:
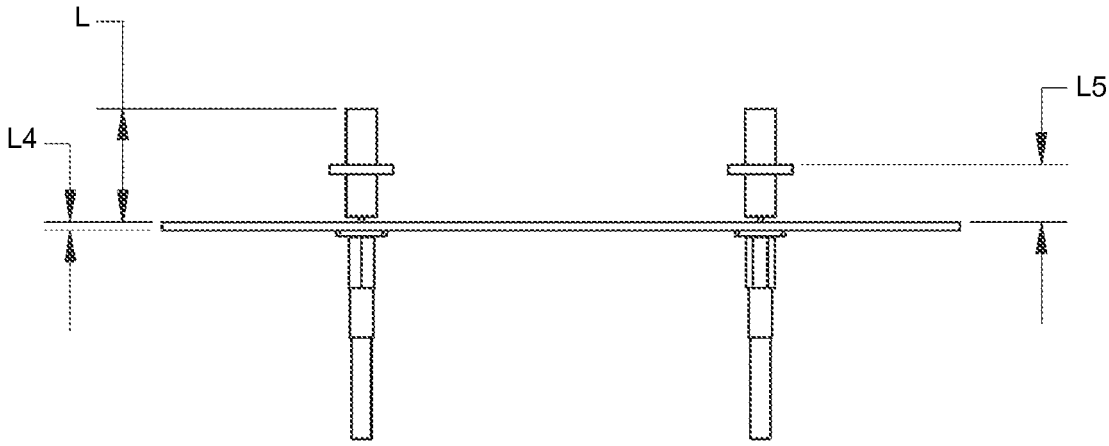

FIGS. 6A and 6B show top and side views of the dual antenna arrangement 500 of FIG. 5. The distance between the antennas is denoted in the drawings as D2 and is selected to provide adequate diversity. In one embodiment, the distance D2 between the antennas is close to one wavelength for the lowest frequency. It is desirable, however, that the antenna arrangement not be too large. For 2450 MHz, one wavelength is more than 122 mm, so the larger dimension of whole ground plane, denoted D3 for both antennas would need to be 230 cm or more, which might be large for many applications (but still within the scope of the invention). The inventor compromised and selected 100 mm as the distance between the two elements 501. Note that any distance, even as small as half a wavelength, or even smaller, would provide some diversity, albeit at some loss of performance. However, such smaller distances are still envisaged by the inventor to be within the scope of the invention. The ground plane is in one embodiment 200 mm by 100 mm, the smaller distance shown denoted as D4.

For the antennas, the length of each, denoted L, is in this embodiment is a little over 28 mm. The distance from the top end of each monopole to the top face of each current suppressing element is around 14 mm, and the distance denoted L5 from the ground plane to the top face of each current suppression element is a little over 14 mm. The thickness of the ground plane is around 2 mm.

This arrangement provides a low profile, dual band, diversity antenna that is very easy to deploy at a low cost.

Figure 7:
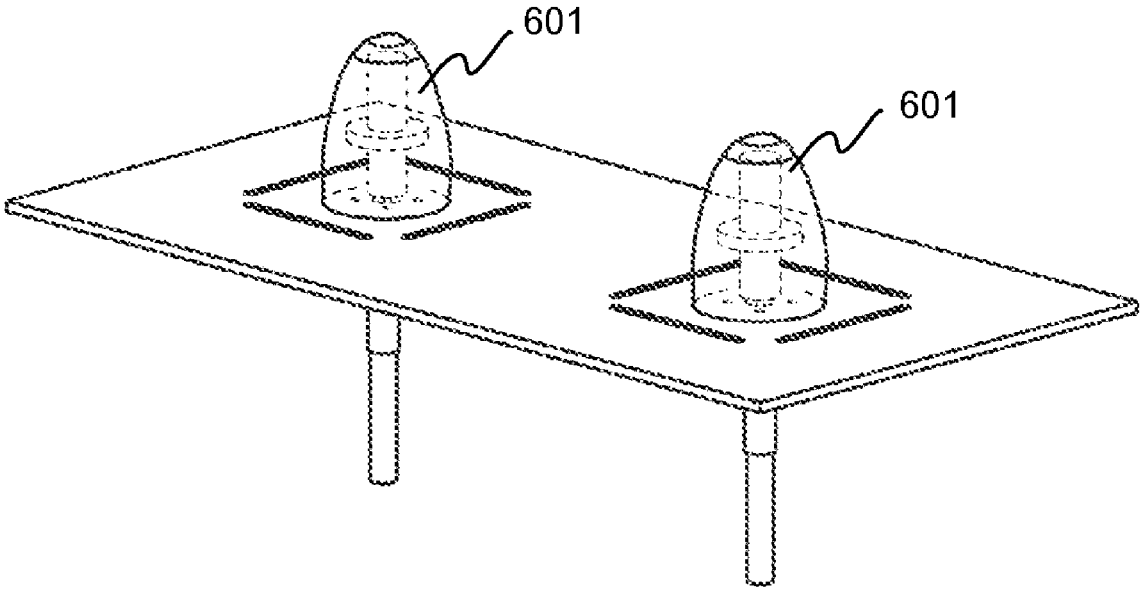
FIG. 7 shows one embodiment of the antenna combination shown in FIG. 5 with a pair of radomes on the antennas.

FIG. 7 shows one embodiment of the antenna combination 500 shown in FIG. 5 with a pair of radomes 601—structural, enclosures used to protect the antenna, at least for esthetic purposes, and made from a material that allows a relatively unattenuated electromagnetic signal between the antenna inside the radome and outside the radome.

The inventor constructed a single antenna as shown in FIG. 1 using the method illustrated in FIG. 2. The monopole was a brass rod with a length of 27 mm and 6.3 mm in diameter. The ground plane was 100 mm by 100 mm sheet of aluminum. The current suppressing element was an aluminum annular-shaped relatively thick disk 16 mm in diameter (see FIG. 4A) with a top face 13 mm from the top end of the monopole. The response variations for the antenna used as a transmit antenna were measured in an azimuth and elevation direction for ranges of frequencies in the 2.4 GHz and 5 GHz range. For these measurements, the elevation plane is a plane perpendicular to the ground plane, i.e., in this embodiment, parallel to the antenna element. The azimuth plane is the plane parallel to the ground plane of the antenna.

Figure 8A:
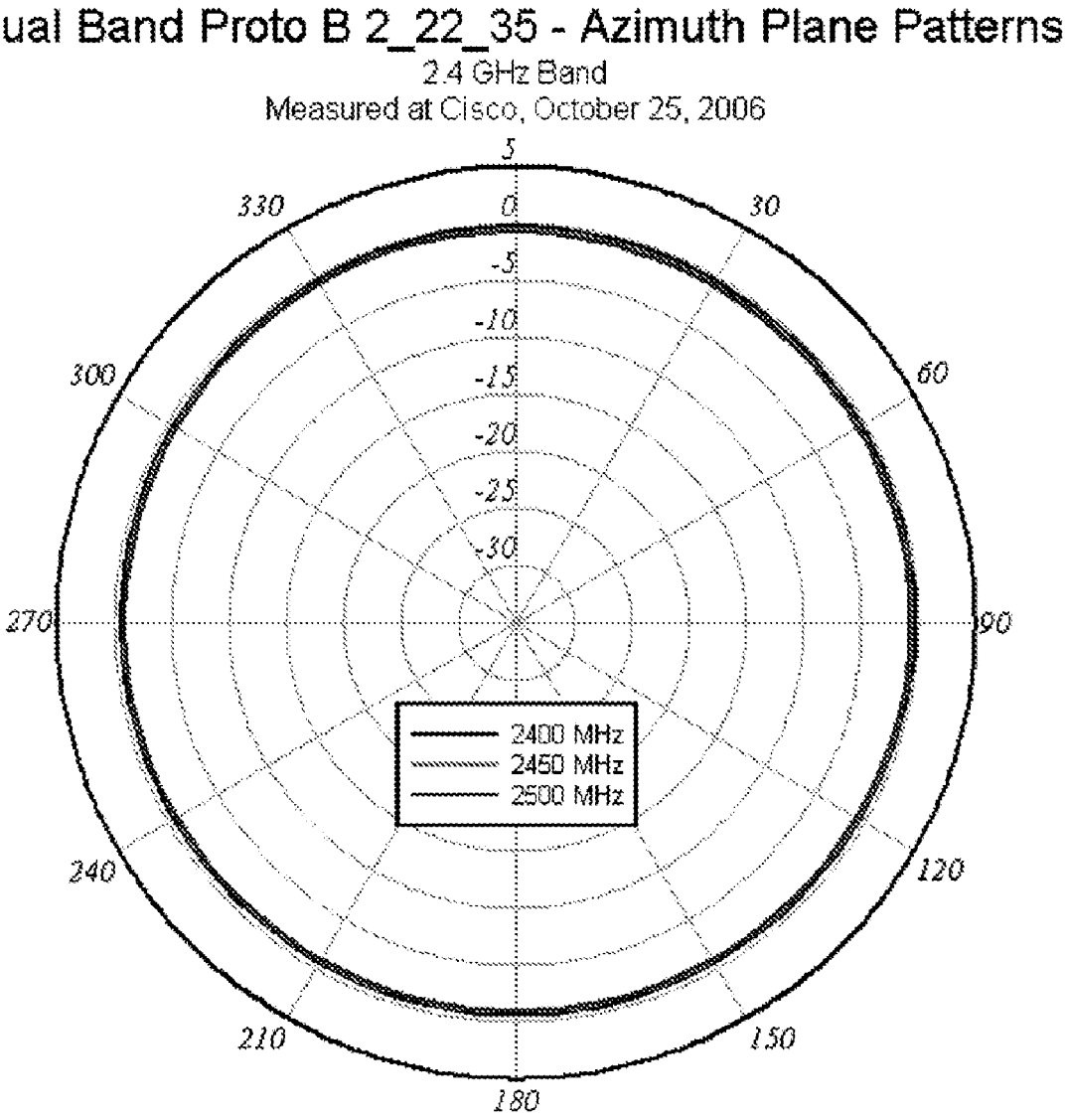
FIGS. 8A and 8B respectively show the measured azimuth plane patterns and measured elevation plane patterns for an antenna embodiment transmitting at frequencies in the 2.4 GHz frequency band used in IEEE 802.11b and 802.11g.
Figure 8B:
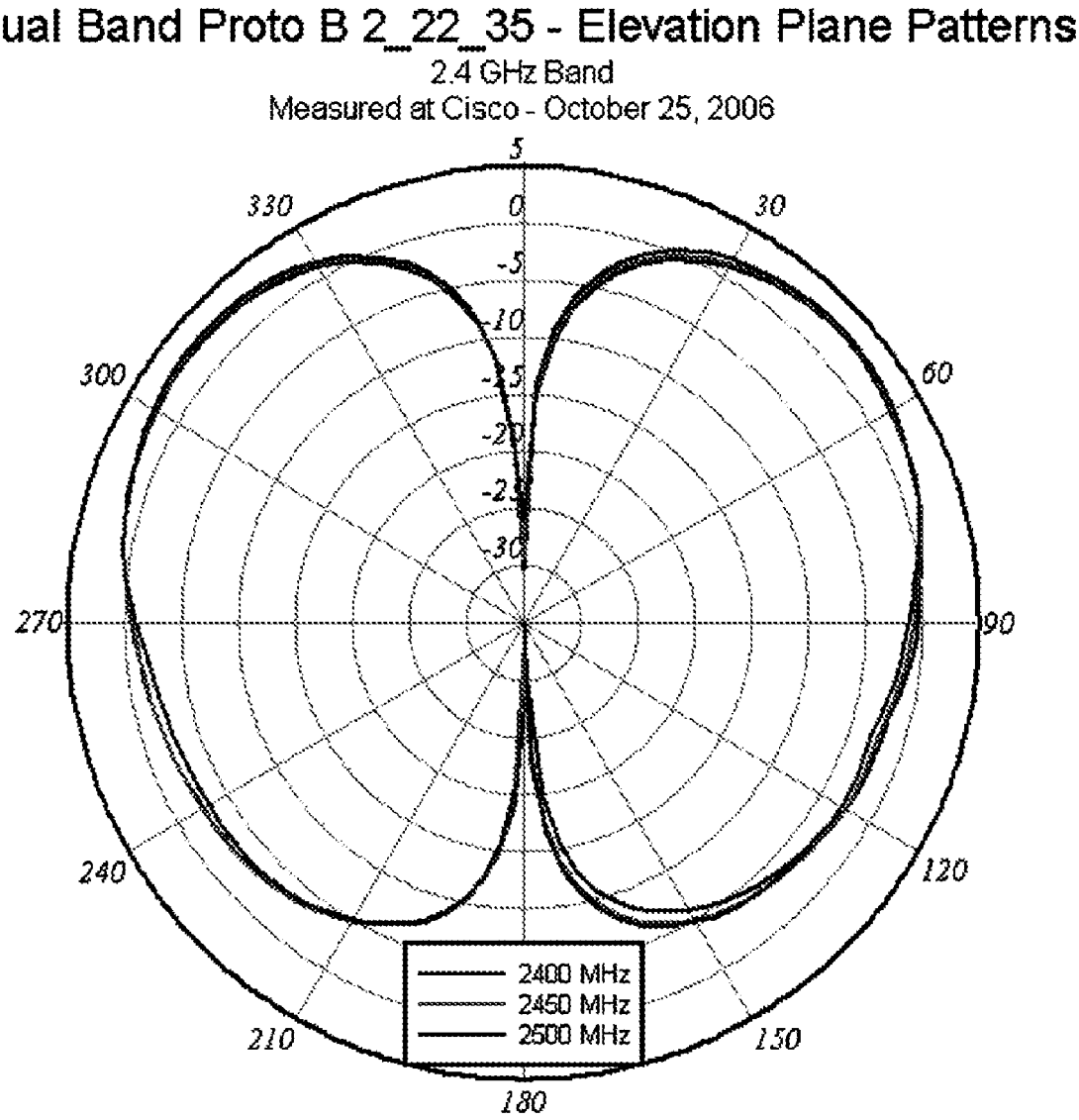
Figure 9A:
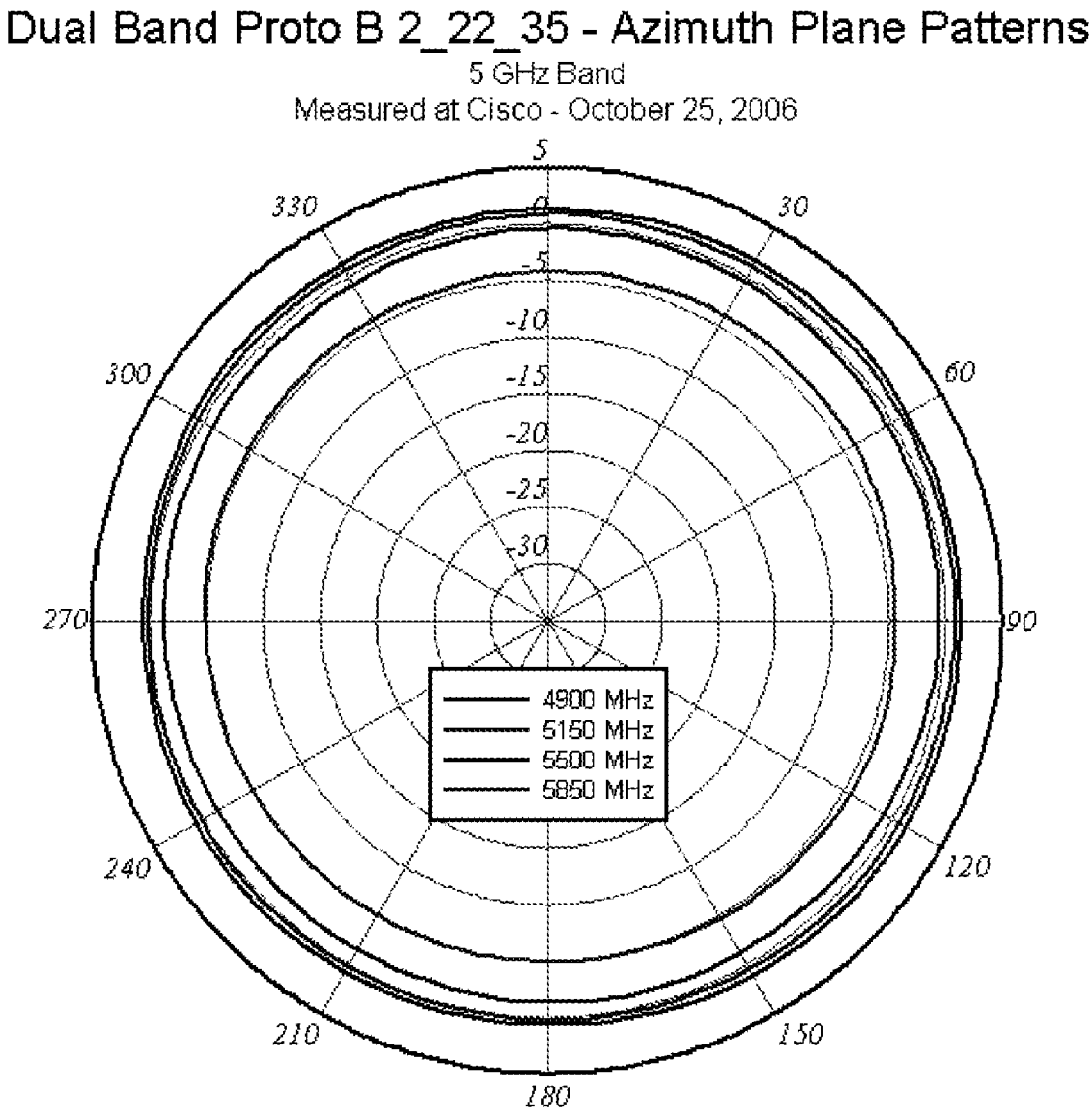
Figure 9B:
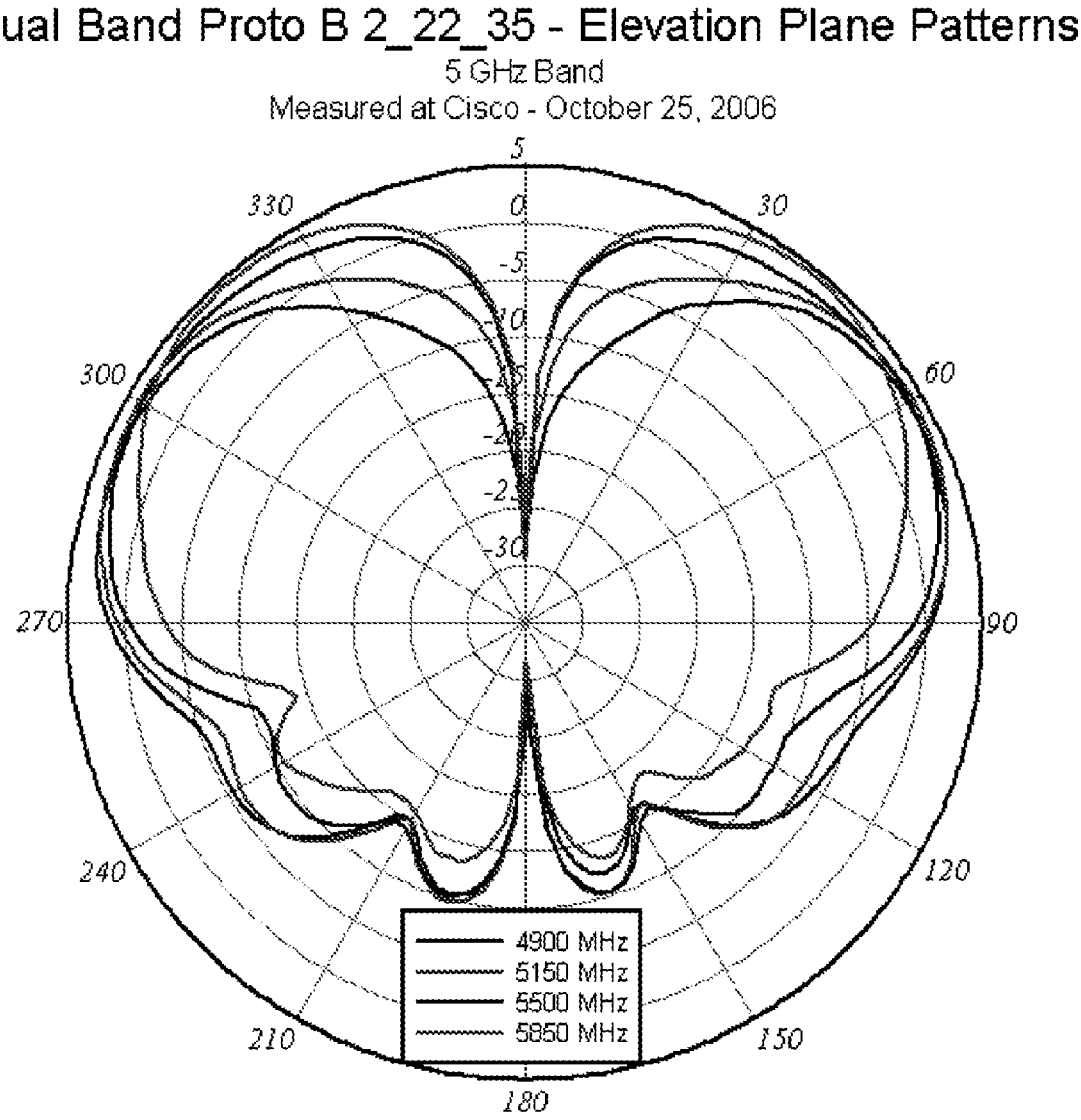

FIGS. 8A and 8B respectively show the measured azimuth plane patterns and measured elevation plane patterns for the shown frequencies in the 2.4 GHz frequency bands used in the IEEE 802.11b and 802.11g standards. FIGS. 9A and 9B respectively show the measured azimuth plane patterns and measured elevation plane patterns for the shown frequencies in the 5 GHz frequency bands used in the IEEE 802.11a standard. In FIG. 9A, the outermost curve is that of the lowest frequency measured, 4900 MHz, and the innermost is for the highest frequency measured, 5850 MHz. In FIG. 9B, the lowest curve is that of the lowest frequency measured, 4900 MHz, and the highest curve is for the highest frequency measured, 5850 MHz.

These measurements show that indeed, the structure produces an antenna that when used to transmit, provides a substantially omnidirectional down-tilted radiation pattern with a simple, relatively inexpensive to construct dual-frequency antenna structure.

While the embodiments of FIGS. 2-4 assume a smooth circular cross section for the monopole element 101, in alternate embodiments, different cross-sectional shapes are used. One embodiment uses a threaded rod as the rod-shaped monopole element, and a common metal hexagonal nut as the current suppressing element. Other than circular cross-sections also are possible. For example, an octagonal cross-section rod-like structure can be used, and so forth.

While the embodiments described show a monopole element that has a uniform cross-section, which is certainly not a requirement. For example, in the case of a circularly symmetric cross-section, a conical section may be used with the diameter of the monopole element varying along the length in the elevation direction.

Yet another embodiment may be diecast as one piece.

Because embodiments of the invention are meant to operate at relatively high frequency bands, e.g., in the GHz range, only the surfaces of the monopole element, the current suppressing element, and the ground plane need be conductive. Therefore, the monopole and current suppressing element can be made of some insulating material, e.g., a plastic, and plated with a conductive metal.

Note that in one embodiment, only a single solder joint is required to connect the antenna to a center conductor of a cable or connector. Note further that a feature of one embodiment is that it does not require any rivets, screws or tuning elements.

Another embodiment of the invention is a transmitter that includes an antenna embodiment as described herein. Yet another embodiment of the invention is a dual band radio receiver that includes an antenna embodiment as described herein. Yet another embodiment of the invention is a wireless station that includes both a receiver and a transmitter, and that includes at least one of the antenna embodiments described herein, and that can operate at two frequencies simultaneously, e.g., receive at one frequency while transmitting at another frequency, or transmit simultaneously at two frequencies.

Figure 10:
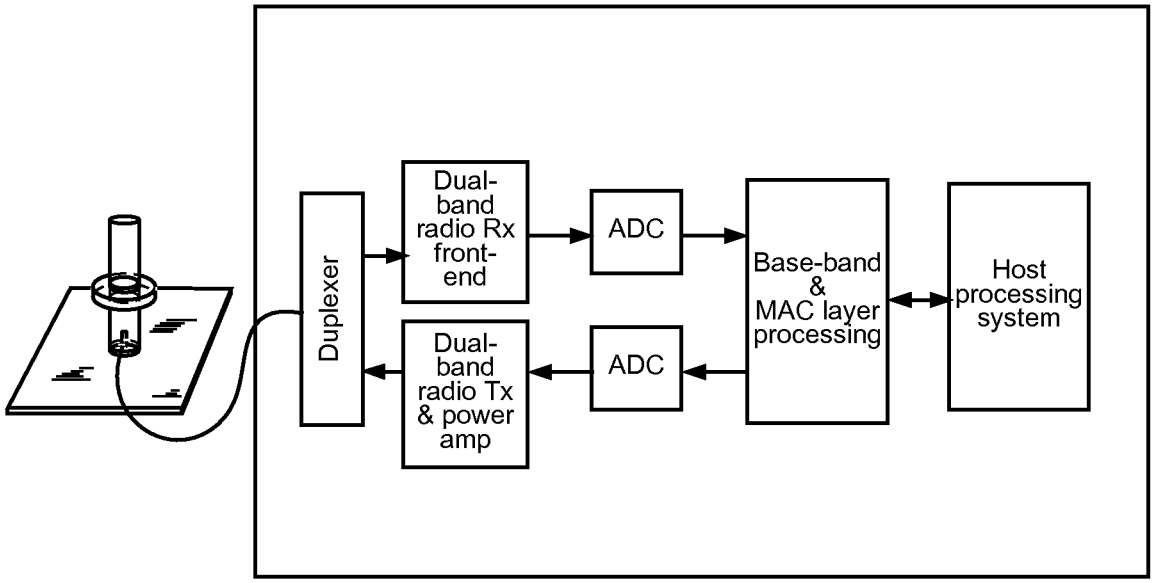
FIG. 10 shows an embodiment of a wireless station that operates at two frequencies, and that includes one or more dual-band antenna embodiments.

FIG. 10 shows one embodiment of the invention that includes an antenna embodiment, e.g., that shown in FIG. 1 in a wireless station 1000. In one version, the wireless station is an access point for operation as a mesh point in a mesh network. The backhaul network of other mesh points operate at one of the frequency bands, e.g., that of 802.11g, while the station acts as an access point for client stations at the other of the two frequency bands, e.g., according to the IEEE 802.11a standard. The wireless station includes a dual band transceiver that includes a dual band receiver (Rx) and a dual band transmitter and power amplifier. One embodiment includes one or more analog-to-digital converters (ADCs) connected to the receiver to supply a baseband and media access control (MAC) processing system with digital samples. Those samples may be at baseband, or not with further downconversion to baseband occurring in the digital domain. One embodiment further includes a host processing system to further process received signals, and to further prepare signals for transmitting. On the transmit side, the baseband and MAC processor s coupled to at least one digital to analog converter (DAC) to supply the transmitter and power amplifier with signals to transmit at one or both of the operating frequency bands.

In another embodiment, the station includes a network interface and is connectable directly to an element of a wired network and is operable as an access point in a wireless local area network.

Other embodiments include other wireless stations that include one or more dual-band radios. Such a station may be a multiple-input multiple-output (MIMI) station that includes an array of antennas for diversity operation.

In keeping with common industry terminology, the terms "base station", "access point", and "AP" may be used interchangeably herein to describe an electronic device that may communicate wirelessly and substantially simultaneously with multiple other electronic devices, while the terms "client," "mobile device" and "STA" may be used interchangeably to describe any of those multiple other electronic devices, which may have the capability to be moved and still communicate, though movement is not a requirement. However, the scope of the invention is not limited to devices that are labeled with those terms.

In the context of this document, the term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not.

Note that when a method is described that includes several elements, e.g., several steps, no ordering of such elements, e.g., steps is implied, unless specifically stated.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention.

In the description provided herein, numerous specific details are set forth. However, it is understood that embodiments of the invention may be practiced without these specific details. In other instances, well-known methods, structures and techniques have not been shown in detail in order not to obscure an understanding of this description.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

"Variants of the IEEE 802.11 standard" as used herein means the variants and proposed variants of the IEEE 802.11 standard. Variants are versions defined in clauses of the standard and proposed amendments of the standard.

It should be appreciated that although the invention has been described in the context of variants of the IEEE 802.11 standard, the invention is not limited to such contexts and may be utilized in various wireless applications and systems, for example in a network that conforms to a standard other than IEEE 802.11, or for example in other systems that include a plurality of radio transmitters or receivers or transceivers to form a device that can operate simultaneously at two frequencies.

While an embodiment has been described for operation in with RF frequencies in the 5 GHz range and 2.4 GHz range (the 802.11a and 802.11b and g variants of the IEEE 802.11 standard), the invention may be embodied in receivers and transceivers operating in other RF frequency ranges.

Furthermore, the invention is not limited to any one type of architecture or protocol, and thus, may be utilized in conjunction with one or a combination of other architectures/protocols. For example, the invention may be embodied in transceivers conforming to other standards and for other applications, including other WLAN standards, Bluetooth, GSM, PHS, CDMA, and other cellular wireless telephony standards.

All publications, patents, and patent applications cited herein are hereby incorporated by reference.

Any discussion of prior art in this specification should in no way be considered an admission that such prior art is widely known, is publicly known, or forms part of the general knowledge in the field.

In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter. For example, the scope of the expression a device comprising A and B should not be limited to devices consisting only of elements A and B. Any one of the terms including or which includes or that includes as used herein is also an open term that also means including at least the elements/features that follow the term, but not excluding others. Thus, including is synonymous with and means comprising.

Similarly, it is to be noticed that the term coupled, when used in the claims, should not be interpreted as being limitative to direct connections only. The terms "coupled" and "connected," along with their derivatives, may be used. It should be understood that these terms are not intended as synonyms for each other. Thus, the scope of the expression a device A coupled to a device B should not be limited to devices or systems wherein an output of device A is directly connected to an input of device B. It means that there exists a path between an output of A and an input of B which may be a path including other devices or means. "Coupled" may mean that two or more elements are either in direct physical or electrical contact, or that two or more elements are not in direct contact with each other but yet still co-operate or interact with each other.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

I claim:

1. An antenna comprising:

(a) a conductive ground plane; and (b) a rod shaped monopole element having a conductive surface, oriented out from the ground plane and having a length selected for a first radio frequency band, the monopole element having a current suppressing element conductively attached and surrounding the surface of the monopole element at a selected first location on the monopole element determined by a second frequency band higher than the first frequency band, wherein the rod-shaped monopole element has a relatively wide cross-section such that the antenna is operable over relatively wide ranges of frequencies in one or both of the frequency bands, and wherein the current suppressing element includes a top conductive face and a bottom conductive face substantially parallel to each other and to the ground plane and conductively coupled to the outer surface of the monopole element at the selected first location, the faces extending out from the surface of the monopole in all directions.

2. An antenna as recited in claim 1, wherein the monopole is uniform in cross-section.

3. An antenna as recited in claim 1, wherein the monopole is circular in cross-section.

4. An antenna as recited in claim 1, wherein the first band is in the 2.4 GHz range, and the second band is in the 5 GHz range.

5. An antenna as recited in claim 4, wherein the monopole is a least 4.7 mm wide in cross-section, and between 25 mm and 33 mm in length, and wherein the current suppressing element is between 11 mm and 14.5 mm from the top end of the monopole that is farthest from the ground plane.

6. An antenna as recited in claim 4, wherein the monopole has a circular cross section of diameter between 6 mm and 7 mm, and a length between 27 mm and 28 mm, and wherein the current suppressing element is located between 13 mm and 14 mm from the top end of the monopole that is furthest from the ground plane.

7. An antenna as recited in claim 4, wherein the ground plane extends at least 35 mm in all directions from the monopole.

8. An antenna as recited in claim 1, wherein the top and bottom faces of the current suppressing element are annular, such that a cross section outline of the monopole and current suppressing element at the selected first location of the current suppressing element is circular in shape.

9. An antenna as recited in claim 1, wherein the top and bottom faces of the current suppressing element are such that a cross section outline of the monopole and current suppressing element at the selected first location of the current suppressing element is polygonal in shape.

10. An antenna as recited in claim 1, wherein the monopole is a metal rod and the current suppressing element is a relatively thin ring-shaped structure with upper and lower faces, pushed onto the metal rod to make electrical contact with the surface of the metal rod, wherein the monopole is made of a first conductive metal, and the wherein the current suppressing element is made of a second conductive metal.

11. An antenna as recited in claim 10, wherein first conductive metal includes brass, and wherein the second conductive metal includes one of brass or aluminum.

12. An antenna as recited in claim 1, wherein the monopole and current suppressing element combination is diecast.

13. An antenna as recited in claim 1, wherein the monopole element has a feed end closest to the ground plane, a top end furthest from the ground plane, and a hole at the feed end into which the center conductor of a coaxial feed wire or the center conductor of a coaxial connector is electrically attachable.

14. An antenna array comprising:

(a) a conductive ground plane; and (b) a plurality of rod shaped monopole elements, each having a conductive surface, oriented out from the ground plane and having a length selected for a first radio frequency band, each monopole element having a respective current suppressing element conductively attached and surrounding the surface of the monopole element at a selected first location on the monopole element determined by a second frequency band higher than the first frequency band, wherein each rod-shaped monopole element has a relatively wide cross-section such that the antenna array is operable over relatively wide ranges of frequencies in one or both of the radio frequency bands, and wherein the current suppressing element includes a top conductive face and a bottom conductive face substantially parallel to each other and to the ground plane and conductively coupled to the outer surface of the monopole element at the selected first location, the faces extending out from the surface of the monopole in all directions.

15. An antenna array as recited in claim 14, wherein the conductive ground plane includes a plurality of conductive planar elements.

16. An antenna as recited in claim 14, wherein the first band is in the 2.4 GHz range, and the second band is in the 5 GHz range.

17. An antenna as recited in claim 16, wherein each monopole is a least 4.7 mm wide in cross-section, and between 25 mm and 33 mm in length, and wherein the current suppressing element is between 11 mm and 14.5 mm from the top end of the monopole that is furthest from the ground plane.

18. A method of manufacturing an antenna, the method comprising:

providing a conductive ground plane;

providing a rod-shaped monopole element having a conductive surface and having a length selected for a first radio frequency band;

providing a current suppressing element including a top conductive face and a bottom conductive face substantially parallel to each other, and a hole configured so that the rod-shaped monopole can fit through the hole;

pushing the current suppressing element onto the monopole element or the monopole element into the hole of the current suppressing element such that the top and bottom conductive faces extend out from the conductive surface of the monopole element, and such that the top and bottom conductive faces are conductively coupled to the outer surface of the monopole element at a selected first location determined by a second frequency band higher than the first frequency band, arranging the combination of the monopole element and current suppressing element substantially perpendicular to the ground plane so the ground plane and the combination form two antenna terminals, wherein the rod-shaped monopole element has a relatively wide cross-section such that the antenna is operable over relatively wide ranges of frequencies in one or both of the frequency bands, and wherein the current suppressing element includes a top conductive face and a bottom conductive face substantially parallel to each other and to the ground plane and conductively coupled to the outer surface of the monopole element at the selected first location, the faces extending out from the surface of the monopole in all directions.

19. A method as recited in claim 18, wherein the first band is in the 2.4 GHz range, and the second band is in the 5 GHz range.

20. A method as recited in claim 18, wherein the monopole element is a least 4.7 mm wide in cross-section, and between 25 mm and 33 mm in length, and wherein the current suppressing element is between 11 mm and 14.5 mm from the top end of the monopole that is furthest from the ground plane.

21. A method as recited in claim 18, wherein the monopole element has a feed end closest to the ground plane, and a top end furthest from the ground plane, the method further comprising:

forming a hole at the feed end;

inserting a center conductor of a coaxial feed wire or the center conductor of a coaxial connector in the hole; and electrically attaching the center conductor to the conductive surface of the monopole element.

22. An apparatus comprising:

a wireless transceiver operable at one of a plurality of frequencies in a band of frequencies at or near 2.4 GHz and simultaneously at one of a plurality of frequencies in a band of frequencies at or near 5 GHz;

an antenna coupled to the wireless transceiver, the antenna including:

(a) a conductive ground plane; and (b) a rod shaped monopole element having a conductive surface, oriented out from the ground plane and having a length selected for the 2.4 GHz band of frequencies, the monopole element having a current suppressing element conductively attached and surrounding the surface of the monopole element at a selected first location on the monopole element determined by the 5 GHz band of frequencies, wherein the rod-shaped monopole element has a relatively wide cross-section such that the antenna is operable over relatively wide ranges of frequencies in one or both of the frequency bands, and wherein the current suppressing element includes a top conductive face and a bottom conductive face substantially parallel to each other and to the ground plane and conductively coupled to the outer surface of the monopole element at the selected first location, the faces extending out from the surface of the monopole in all directions.

23. An apparatus as recited in claim 22, wherein the monopole is a metal rod and the current suppressing element is a relatively thin ring-shaped structure with upper and lower faces, pushed onto the metal rod to make electrical contact with the surface of the metal rod.

* * * * *